United States Patent [19]

Chollet et al.

[11] Patent Number: 4,982,671

[45] Date of Patent: Jan. 8, 1991

[54] VEHICLE WITH STEERABLE AXLES

[75] Inventors: Hugues Chollet; Jean-Louis Maupu, both of Arceuil; Jean-Michel Petit, Le Pre Saint Gervais, all of France

[73] Assignees: Alsthom, Paris; Instit National de Recherche sur les Transports et leur Securite, Arceuil, both of France

[21] Appl. No.: 280,117

[22] Filed: Dec. 5, 1988

[30] Foreign Application Priority Data

Dec. 3, 1987 [FR] France ..... 87 16789

[51] Int. Cl.[5] ..... B61F 5/00; B61F 3/04

[52] U.S. Cl. ..... 105/168; 105/199.4

[58] Field of Search ..... 105/168, 165, 4.4, 167, 105/177, 170, 176, 169, 133, 136, 171, 144.4; 246/196, 170; 104/287, 242

[56] References Cited

U.S. PATENT DOCUMENTS

| | | | |
|---|---|---|---|
| 3,376,830 | 4/1968 | Bingham | 105/133 |
| 3,387,569 | 6/1968 | Lich | 105/196 |
| 3,557,707 | 1/1971 | Joy | 105/136 X |
| 4,003,316 | 1/1977 | Monselle | 105/167 |
| 4,022,133 | 5/1977 | Lindblom et al. | 104/242 X |
| 4,289,075 | 9/1981 | Smith | 105/168 |
| 4,526,107 | 7/1985 | Mautner | 105/133 |

FOREIGN PATENT DOCUMENTS

| | | | |
|---|---|---|---|
| 2522704 | 12/1976 | Fed. Rep. of Germany | 104/242 |

*Primary Examiner*—Robert P. Olszewski
*Assistant Examiner*—A. Muratori
*Attorney, Agent, or Firm*—Sughrue, Mion, Zinn, Macpeak & Seas

[57] ABSTRACT

The invention relates to a vehicle having steerable axles. A track guide vehicle comprises at least one pair of independent wheel axles, and at least two members (14, 15) for measuring the transverse position of the vehicle relative to the track, and it is characterized in that it includes at least one measuring member (20) for measuring the angle of the axles relative to references related to portions of the vehicle, and at least two actuator members (21) for correcting said angles by bearing against said axles, and a servo-control circuit receiving the signals from said measuring members and generating control signals for said actuator members.

8 Claims, 5 Drawing Sheets

VEHICLE WITH STEERABLE AXLES

The present invention relates to a vehicle with steerable axles having independent wheels.

The universal development of the railroad has been facilitated by the simple and rough-and-ready technology it uses: a solid one-piece steel axle having conical steel wheels running on two rails of steel. It is commonly considered as being obvious that the rails guide the train. This is not true, in fact the train is capable of running on the rails and following their path without making lateral contact therewith, by virtue of its one-piece axles.

By making use of the linear speed differential of the points of contacts of its two wheels, due to their conical shape, and above all because of its being offset transversely across the track, a one-piece axle provides mechanical servocontrol of its own transverse position. Any lateral offset gives rise to a moment of force tending to steer the axle in the direction which will guide it back towards the center of the track by means of lateral forces which are a function of the angle reached. These forces contain viscous type damping terms which, unfortunately become less with increasing forward speed of the train. The study of the dynamic stability of axles subjected to contact forces and to connection forces with a chassis constitutes the field of rail dynamics. Contact is investigated experimentally and is integrated in calculation models by Kalker's representation which has replaced the conventional dynamic representation. (J. J. Kalker, "On the rolling contact of two elastic bodies in the presence of dry friction" Thesis, Delft, 1967.)

The main function of the one-piece axle is to ensure that curves in the track are followed by means of this steering servo-control by position due to the conical effect, without there being any lateral contact between the wheels and the rails, thus avoiding friction and wear. However, with increasing speed, instabilities become a problem due to the increasing disequilibrium between the constant angular return forces and the natural damping forces which are inversely proportional to speed.

At high speed, the natural damping forces due to wheelrail contact are no longer sufficient to ensure axle stability which must be obtained by a chassis to which the axles are connected by resilient connections referred to as primary suspension. These connections must be very stiff in order to improve stability at high speeds. Unfortunately, this high stiffness opposes the relative steering of two axles as required in order to ensure rolling contact without sliding when going round a curve.

Thus, to go around a curve having a radius of 50 meters, two axles which are two meters apart must form an angle between each other of 40 milliradians, and this would give rise to suspension return forces which are too great to be overcome solely by the contact forces.

Numerous efforts have been made in the past to facilitate proper steering of one-piece axles while going round curves by steering the axles mechanically, e.g. as a function of the angle between the bogie chassis and the body of the vehicle. These developments are referred by the generic term "steerable axle bogies". However, these solutions do not give full satisfaction since they tend to increase instability at high speeds, and they operate poorly in zones where the radius of curvature is varying. In addition, even when they ensure that the axles do indeed extend radially in curves, they still do not prevent the sliding which occurs when the conical shape of the wheels and the play of the axles are insufficient for compensating the path length difference between two rails.

Proposals have also been made, in particular for avoiding the above drawback, whereby the two wheels on a single axle are no longer constrained to rotate together, thereby providing "independent wheel axles". Such implementations have remained relatively rare since independent wheel axles are no longer sensitive to the effects of conical wheel shape and no longer have a moment of force suitable for steering them naturally. They therefore need a steering device to be added which is capable of making them follow curves without sliding.

In the past such devices have been mechanical and have sought to steer each axle in a direction which is tangential to the track, as detected by observing a portion of the preceding vehicle. Naturally, such devices cause difficulties at the ends of the train.

Other devices have been proposed, but, in practice, it appears that if they improve curve-following, then they reduce stability, and vice versa. Thus, in practice, rolling stock has been specialized in at least two categories: high speed vehicles which are not suitable for negotiating tight curves; and urban vehicles which are most uncomfortable at higher speeds.

In order to mitigate these drawbacks, proposals have been made to steer an axle having independent wheels which are completely free to rotate relative to the body of the vehicle using electronic servo-control means including a draw bar extending perpendicularly to the wheel axes and supporting electromagnets and position sensors which co-operate with a rail placed in the middle of the track.

By means of this servo-control, it is possible to implement a transfer function relating the orientation of the axle to its transverse position y (relative to the ground), of the form:

$$\alpha = Gy + Dy'$$

such that the contact forces Fy of the axle, at high speed, are equal to:

$$Fy = 2C_{22}\alpha = 2C_{22}Gy + 2C_{22}Dy'$$

It can thus be seen that servo-control solves two problems: it gives rise to a centering term which is proportional to the lateral displacement y (which term replaces the conical shape of the wheels), thereby making the axle suitable for following curves, and it introduces damping ($2C_{22}D$) which is independent of the speed of advance and which enables the axle to be stabilized at high speeds without making use of chassis connection forces.

However, the above-mentioned device suffers from several drawbacks: the draw bar connected to the axle cannot be stabilized in pitching or "galloping" without providing it with connections to the body of the vehicle, thereby giving rise to vibration which is difficult to filter and which reduces comfort.

In addition, in order to keep the electromagnets to an acceptable size, it is necessary to reduce the interferring torques applied to the axle by braking or by propulsion.

In this case, a centered linear motor is used whose stator may constitute the guide rail. Finally, the presence of the guide rail makes this solution difficult to apply in existing rail networks.

It is recalled that guided vehicles may skid and come into transverse abutment with the track via their flanges, thereby requiring suspension having good transverse flexibility and leading to a common path being sought for all of the axles. Various simple solutions used for wire-guided devices are not applicable thereto.

The object of the present invention is to improve this situation by proposing a vehicle in which axle steering is servo-controlled from non-contacting position sensors which co-operate with conventional rails and which make use of actuators that do not co-operate with the track but with the axles, either directly or indirectly via the chassis of a bogie or the chassis of a rail vehicle. While retaining high critical speeds and the possibility of negotiating tight corners without wheel wear, this system improves comfort and track holding, and allows wheels to be used for traction and for braking and even allows wheels to be used having pneumatic tires while avoiding the use of transversely disposed guide wheels.

The term "vehicle" is used herein to designate a unit which is self-contained, at least with respect to support and guidance.

The present invention provides a track guided vehicle comprising at least one pair of independent wheel axles and at least two members for measuring the transverse position of the vehicle relative to the track, characterized in that it comprises at least one axle angle measuring member for measuring angles relative to references related to portions of the vehicle, and at least two actuator members bearing against said axles and enabling said angles to be corrected, and a servo-control circuit receiving the signals from said measuring members and generating control signals for said actuator members.

The invention will be better understood from the following description of three embodiments made with reference to the accompanying drawings, in which.

In FIGS. 1 to 6, the axis of rotation between the axles of a bogie is mechanically defined by a ball-and-socket type of joint; the bogie includes only one angle sensor between its axles, with one of the axles constituting the reference from which said angle is measured.

The bogie includes only one actuator which bears against the axles in order to correct the angle between the axles.

Figure 1:
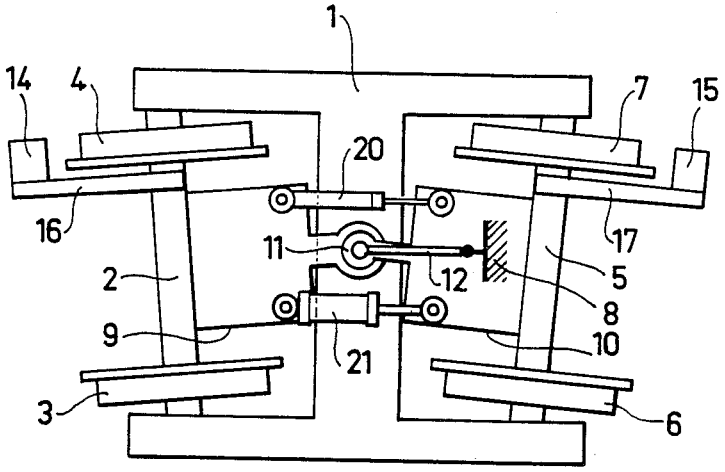
FIG. 1 is a diagrammatic plan view of a bogie in accordance with a first embodiment.

The bogie shown diagrammatically in FIG. 1 comprises a chassis 1 and two axles which are hinged to each other by means of a ball-and-socket joint 11 placed in the center of the bogie for reasons of symmetry (two-way bogie). Each axle includes a transverse member 2 or 5 together with two independent wheels 3 and 4 or 6 and 7, and a pseudo-chassis 9 or 10 connecting the corresponding transverse member 2 or 5 to the ball-and-socket joint 11. An angle sensor 20 and an actuator 21 are disposed between the two pseudo-chassis 9 and 10.

By way of example, the actuator may be a hydraulic actuator or an electric actuator.

Each of the transverse members 2 and 5 has a rail sensor (14, 15) fixed thereto in the vicinity of the corresponding wheel and serving to measure the displacement of the axle relative to the corresponding rail (not shown).

The rail sensors 14 and 15 are advantageously of the type described in U.S. patent application Ser. No. 01/250,808 filed Sept. 28, 1988 in the name of the Applicants.

Such sensors comprise a magnet having a degree of freedom relative to the axle which is tangential to the measurement direction, and constrained to remain in the same transverse position relative to the rail. Displacement of the magnet relative to the rail is measured, thereby measuring the displacement of the axle relative to the rail.

In a variant, the sensors 14 and 15 may be fixed to the elements 9 and 10 of the pseudo-chassis.

The sensors provide the following electrical signals:

Y1: the difference between the transverse position of the sensor 14 and the track;

Y2: the difference between the transverse position of the sensor 15 and the track; and $\alpha$: the relative angle between the two axles as deduced from the sensor 20.

Figure 9:
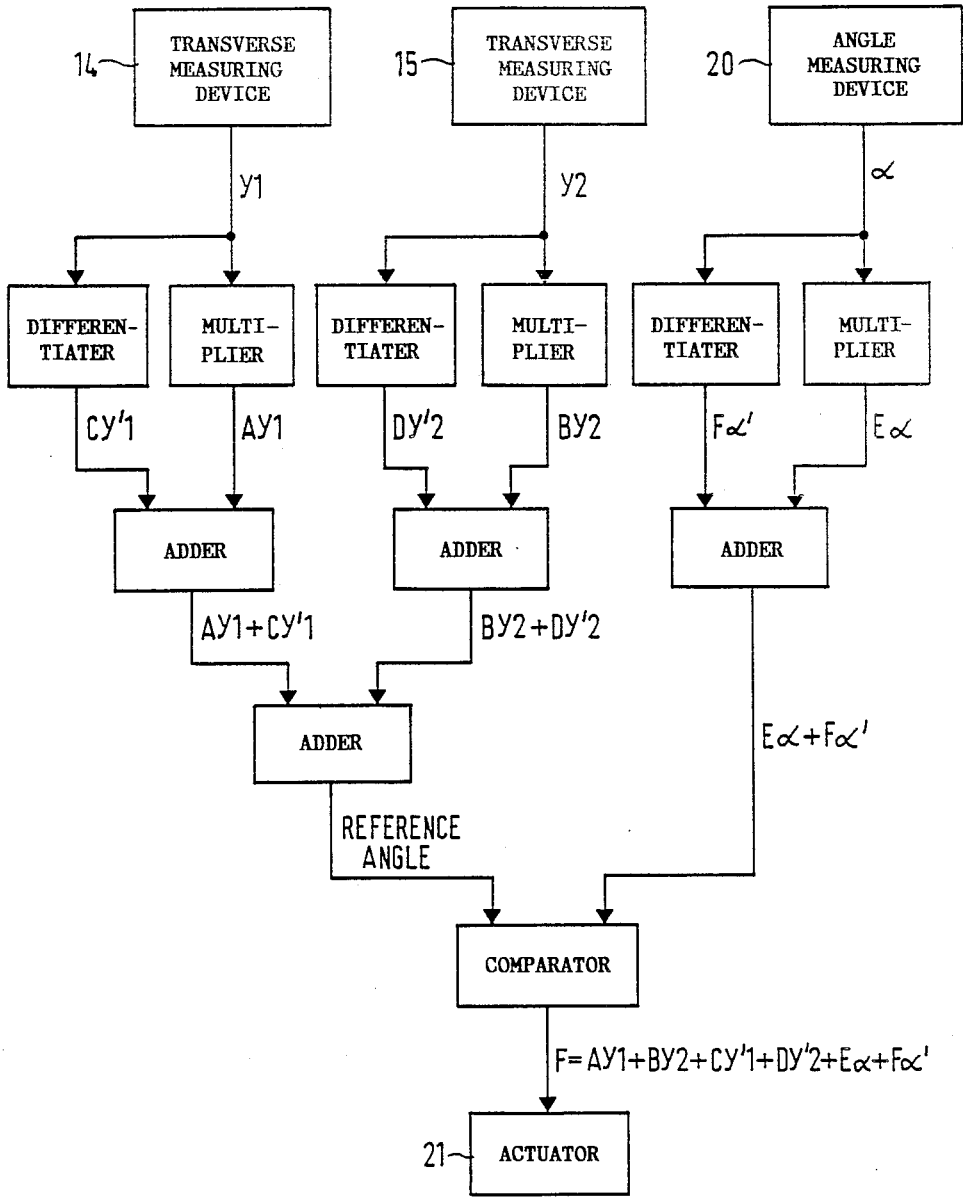
FIG. 9 is a block diagram of a servo-control circuit for a servo-mechanism forming a part of the bogie of this invention.

An electronic servo-control circuit FIG. 9 provides a reference signal of the actuator force, e.g. of type:

$$F = AY1 + BY2 + CY'1 + DY'2 + E\alpha + F\alpha'$$

where A, B, C, D, E, and F are factors which may depend on the speed of the vehicle, and Y'1, Y'2, $\alpha'$ are the derivatives of Y1, Y2, and $\alpha$ respectively with respect to time.

By analogy with the description of the introduction, the expression for the angle between the axles, or reference angle, is as follows:

$$\alpha = -(AY1 + BY2 + CY'1 + DY'2)/E$$

The signal from the sensor at the rear of the bogie is not absolutely essential, but it makes it possible to center the bogie better on a curve under transverse forces (B non-zero) and to increase the critical speed of the bogie (D non-zero), in particular if the time constants of the electronics and of the force servo-controlled actuator are not negligible (e.g. are not less than 10 microseconds).

The longitudinal traction or braking forces are advantageously transmitted directly to the body 8 of the vehicle (without passing via the bogie chassis 1) by means of a connecting rod 12 hinged to the body 8 and to the ball-and-socket joint 11 at one of the pseudo-chassis 9 or 10.

In this case, the chassis 1 serves merely to distribute vertical and transverse supporting and guidance forces for the body from the two ends of each axle transverse member.

Figure 2:
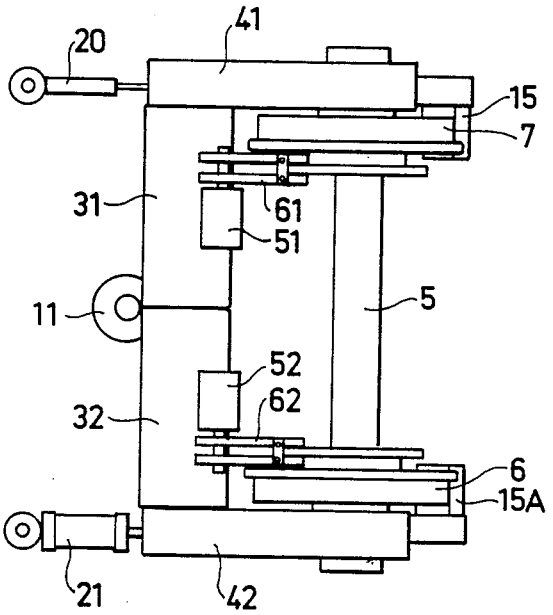
FIG. 2 is a plan view of one of the axles of the FIG. 1 bogie with each wheel having a suspension arm forming transmission case and motor.

FIG. 2 is a plan view of an axle for implementing a bogie in accordance with the principles described with reference to FIG. 1.

Items which are common to FIGS. 1 and 2 have the same reference numerals.

The axle comprises two motors, one for each of its wheels, which motors are enclosed in housing 31 and 32.

Transmission is provided via chains enclosed in housings 41 and 42. The assemblies 31–41 and 32—42 act as the pseudo-chassis 9 and 10 of FIG. 1.

FIG. 2 also shows disk brakes comprising motors 51 and 52 and respective calipers 61 and 62.

A rail position sensor 15A is fixed to the housing 42.

Figure 3:
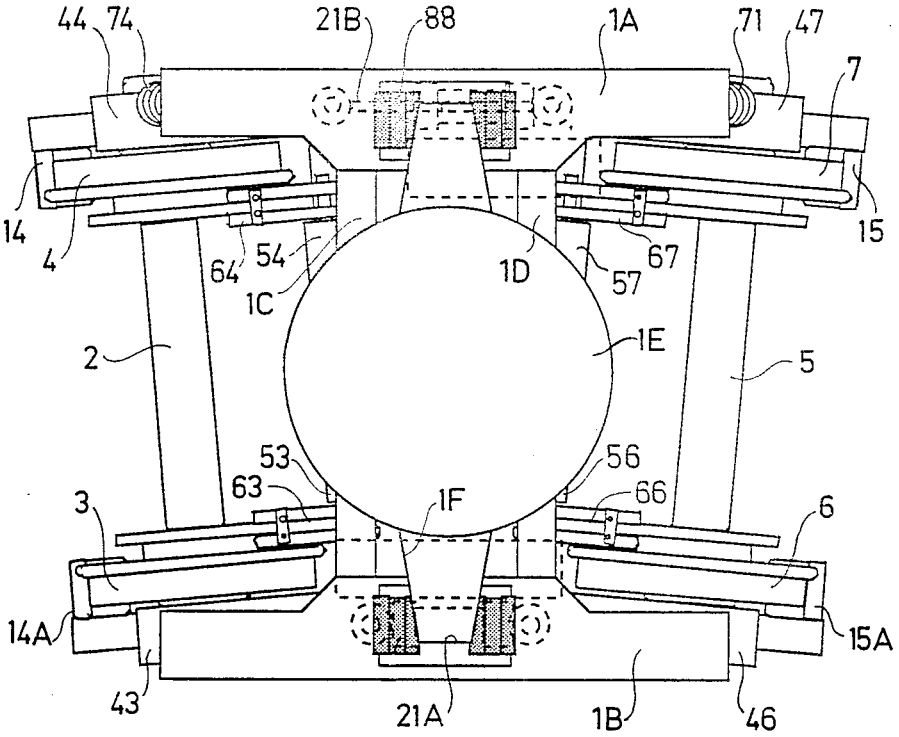
FIG. 3 is a plan view of a bogie constituted by two axles made in accordance with FIG. 1.
Figure 5:
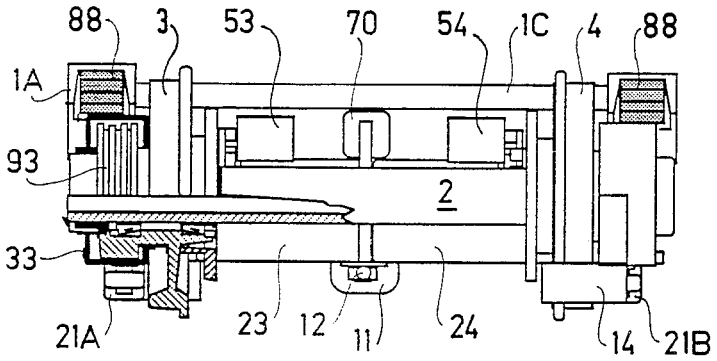
FIG. 5 is a front view of the same bogie.

Using two axles of the above type, a bogie is made as shown in FIGS. 3 and 5.

Items which are common to FIGS. 1 to 5 have the same reference numerals.

The transverse members 2 and 5, the wheels 3, 4, 6, and 7, and the rail sensors 14, 14A, 15, and 15A can be seen.

The motors can also be seen under references 23 and 24, FIG. 5.

The motor housings are referenced 33 and 36, the transmission housings are referenced 43, 44, 46, and 47, the brake motors are referenced 53, 54, 56, and 57, and the calipers are referenced 63, 64, 66, and 67.

The motor housings and the transmission housings are fixed back-to-back and constitute the pseudo-chassis 9 and 10 of FIG. 1. They are hinged together at the bottom by the ball-and-socket joint 11 and at the top by a block 70 of elastomer.

Figure 4:
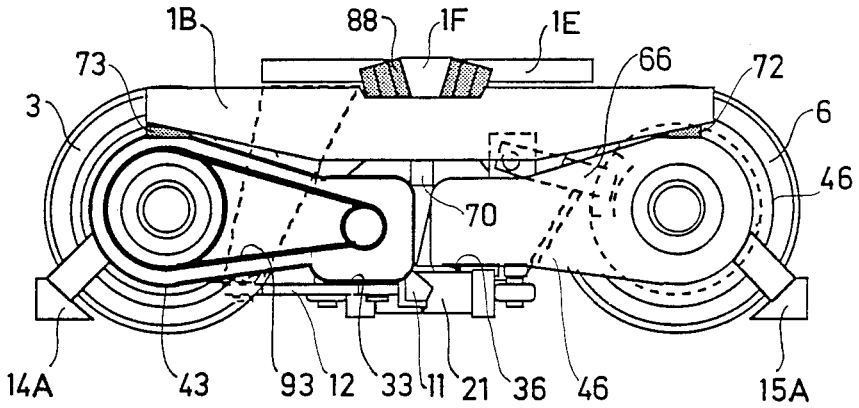
FIG. 4 is an elevation view of the same bogie.

FIG. 4 shows the chain 93 constituting the transmission from the motor 23, FIG. 5 to the wheel 3. The figure also shows the motor 26 of the wheel 6.

The chassis comprises two longitudinally extending members 1A and 1B and two transverse members 1C and 1D. The chassis rests on the transmission housings 41 to 44 level with the axle transverse members 2 and 5 via suspension means 71 to 74 which are equivalent to conventional primary suspension means, but which are characterized by a high degree of longitudinal flexibility.

The bodywork (not shown) is conventionally hinged to the chassis via a secondary suspension including, for example, a ball ring 1E, a load supporting transverse member 1F, and pairs of elastomer blocks such as 88.

It may be observed that the pseudo-chassis, constituted by the motor and transmission housings, by the ball-and-socket joint 11, and by the block 70, provides the bogie chassis, the motors, the actuators, the sensors, and the brakes with suspension which is independent, by means of rotation between the transverse axis pseudo-chassis thus compressing the block 70, while simultaneously making it possible to steer the axles relative to each other by virtue of rotation of the vertical axis by bending the block 70 and allowing warping, i.e. rotation between the axles about a longitudinal axis by subjecting the block 70 to shear. The ball-and-socket joint is thus prestressed.

In order to obtain redundancy and to avoid putting too much stress on the ball-and-socket joint 11, two electrohydraulic or electric servo-actuators 21A and 21B are used, each preferably including an angle sensor, said actuators being placed on either side of the ball-and-socket joint in the same horizontal plane so that the resulting servo mechanism interferes as little as possible with rotary movements other than those about the vertical axis which it is supposed to control. They are hinged beneath the transmission housings 41 to 44.

The servo actuator may be a hydraulic actuator controlled, for example, by a pressure servo valve which is pressure controlled so as to provide force servo-control as mentioned, or by an electrical actuator, e.g. a two stage actuator as in FIG. 9 with a first stage which is rapid for correcting small amplitude offsets, typically between a pair of electromagnets acting on a plate which is fixed to the axle pseudo-chassis and carried by a screw having a nut which is driven by a servo motor constituting the second, slower stage. This stage provides larger amplitude correction for negotiating curves.

A connecting rod 12 for transmitting traction and braking forces is hinged to one of the pseudo-chassis close to the ball-and-socket joint and as low as possible in order to limit the pitching torque and to interfere as little as possible with the suspension of the motors and the servo mechanism.

Figure 6:
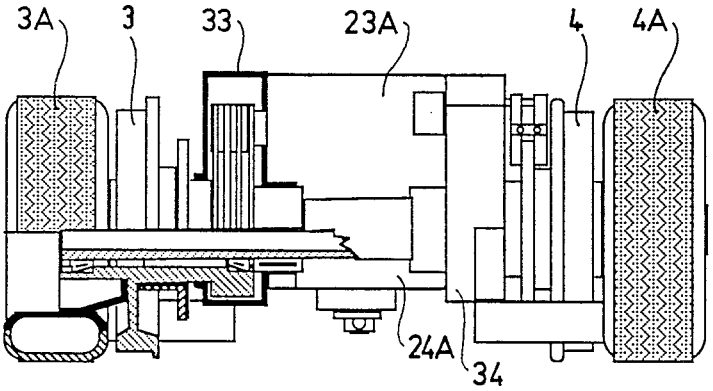
FIG. 6 is a front view of a bogie of the preceding type provided with wheels having pneumatic tires in addition to its metal wheels.

FIG. 6 shows a bogie made on the same principle as the bogie of FIG. 1 but fitted with pneumatic tires 3A and 4A. In order to save space, the transmissions and their housings 33 and 34 are placed between the wheels 3 and 4 of an axle; since the motors 23A and 24A cannot be connected back-to-back, they are placed one on top of the other.

Figure 7:
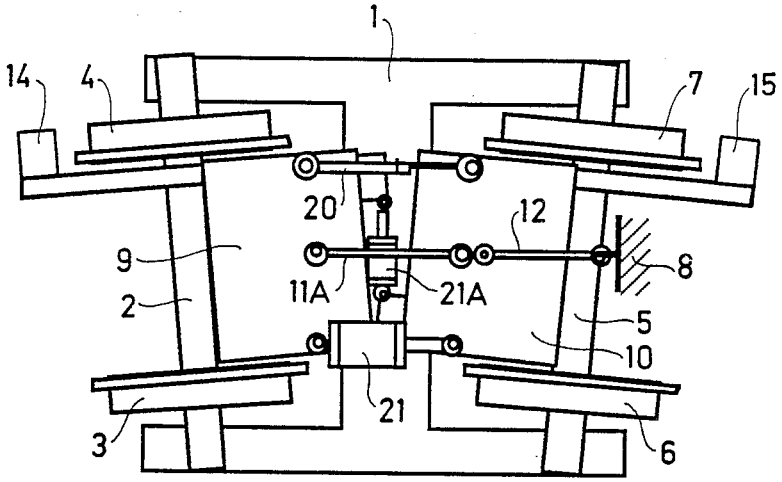
FIGS. 7 and 8 are diagrammatic plan views of a variant embodiment of a bogie shown in two different positions.
Figure 8:
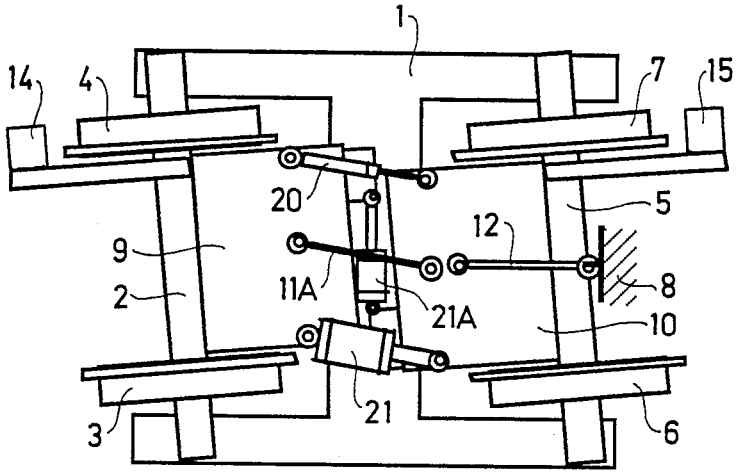

FIGS. 7 and 8 are diagrammatic plan views of a variant bogie which isolates the servo mechanisms from the motion of the chassis.

The bogie is shown with its axles in two different orientations.

The overall design of the bogie is comparable to that of the bogie shown in FIGS. 1 to 6. It retains the pseudo-chassis 9 and 10 associated with the axles, but the ball-and-socket joint 11 defining a center of relative rotation between the axles is replaced by a longitudinal connecting rod 11A hinged on the two pseudo-chassis 9 and 10 in order to provide a new degree of freedom in relative translation between the axles. This connecting rod continues to co-operate with the block 99 in order to provide suspension for the motors, the actuators and their sensors, and the warping connections, and with the actuator 21 in order to exert pure torque on the axles. To this end, the connecting rod lies substantially in the same horizontal plane as the linear actuator and is of the same length when the axles are at a zero angle to each other. In order to connect the two pseudo-chassis longitudinally without any excessive interferring couple, it is preferably centered. The sensor 21 of length equivalent to the connecting rod provides information concerning the angle between the axles. A second actuator 21A having a short stroke together with its associated position sensor serves to displace the center of relative rotation between the axles. It is hinged to the two pseudo-chassis 9 and 10 and its axis is transverse in order to exert transverse thrusts on each of the axles at the center of the bogie. The actuator may be a hydraulic actuator, but given its small stroke, this actuator may be constituted by a pair of electromagnets fixed on one of the pseudo-chassis and acting on at least one plate fixed on the other pseudo-chassis.

The block (FIGS. 4 and 5) may be retained. It must have good transverse flexibility (in shear) and the actuator 21 is disposed slightly below or on either side of it when constituted by electromagnets.

The connecting rod 12 is still hinged to one of the pseudo-chassis close to one of the hinges of the connecting rod 11A, and it is also connected to the body 8 of the vehicle.

In this way, the actuators and sensors have greater thrust against the chassis of the bogie.

The invention makes it possible to provide high speed vehicles which are stable and which are capable of negotiating curves at high speed without giving rise to excessive flange wear.

We claim:

1. A bogie, for a track guided vehicle including a body, said bogie comprising: a pair of independent wheel axles, measuring means for measuring the transverse positions of said wheel axles relative to the track, at least one measuring means for measuring the angle between said axles, at least one actuator member acting between said axles to correct said angle and a servo-control circuit receiving signals from said measuring means and generating control signals for said actuator member.

2. A bogie according to claim 1, wherein each axle of said pair of axles is rigidly linked to a corresponding pseudo-chassis, means for hinging said pseudo-chassis to each other substantially about a vertical axis, and said angle measuring means and said actuators operatively engaging both pseudo-chassis.

3. A bogie according to claim 2, wherein each wheel is operably associated with a drive motor disposed in a housing and provided with a drive member inside the drive housing, said housings constituting at least a portion of said pseudo-chassis.

4. A bogie according to claim 2, wherein said hinge is constituted by both a ball-and-socket joint and an elastomer block between the two pseudo-chassis.

5. A bogie according to claim 2, further includes at least one connecting rod for conveying traction and braking forces, and said connection rod being hinged between one of said pseudo-chassis and the body of the vehicle.

6. A bogie according to claim 2, wherein said body is suspended by means of a primary suspension including two longitudinal members fixed in a flexible manner to the drive housings and a secondary suspension including a transverse member fixed to the longitudinal members by resilient means.

7. A bogie according to claim 1, further comprises wheels having pneumatic tires, in addition to metal wheels.

8. A bogie according to claim 1, wherein each axle of said pair of axles is associated with a corresponding pseudo-chassis, said pseudo-chassis being interconnected by a connecting rod which is hinged to each of them, said pseudo-chassis being connected by a first actuator which, in association with said connecting rod, exerts a torque between the two axles, and by a second actuator exerting a transverse force between the two axles.

* * * * *